US009082575B2

(12) United States Patent
Yamashita et al.

(10) Patent No.: US 9,082,575 B2
(45) Date of Patent: Jul. 14, 2015

(54) ELECTROMAGNETIC RELAY

(75) Inventors: Tsukasa Yamashita, Yamaga (JP); Tetsuo Shinkai, Yamaga (JP); Yasuyuki Masui, Kumamoto (JP); Masayuki Noda, Osaka (JP)

(73) Assignee: OMRON CORPORATION (JP)

( * ) Notice: Subject to any disclaimer, the term of this patent is extended or adjusted under 35 U.S.C. 154(b) by 0 days.

(21) Appl. No.: 13/982,870

(22) PCT Filed: Mar. 25, 2011

(86) PCT No.: PCT/JP2011/057282

§ 371 (c)(1),
(2), (4) Date: Oct. 9, 2013

(87) PCT Pub. No.: WO2012/124174

PCT Pub. Date: Sep. 20, 2012

(65) Prior Publication Data

US 2014/0022035 A1 Jan. 23, 2014

(30) Foreign Application Priority Data

Mar. 14, 2011 (JP) ..... 2011-055721
Mar. 14, 2011 (JP) ..... 2011-055725
Mar. 15, 2011 (JP) ..... 2011-056915

(51) Int. Cl.
*H01H 9/02* (2006.01)
*H01H 50/04* (2006.01)
(Continued)

(52) U.S. Cl.
CPC ..... *H01H 50/04* (2013.01); *H01H 9/443* (2013.01); *H01H 50/24* (2013.01)

(58) Field of Classification Search
CPC ..... H01H 51/065; H01H 9/443; H01H 50/00; H01H 50/60; H01H 9/34; H01H 9/44; H01H 50/36; H01H 51/01; H01F 7/14; H01F 7/1646; H02H 1/0007
USPC ..... 335/201, 202
See application file for complete search history.

(56) References Cited

U.S. PATENT DOCUMENTS 2,735,968 A * 2/1956 Bogue et al. ..... 335/275
2,875,304 A 2/1959 White
(Continued)

FOREIGN PATENT DOCUMENTS

EP 1168392 A1 1/2002
EP 1923898 A1 5/2008
(Continued)

OTHER PUBLICATIONS

Korean Office Action for corresponding application No. 10 2013 7003960; Dated May 23, 2014.
(Continued)

*Primary Examiner* — Shawki S Ismail
*Assistant Examiner* — Lisa Homza
(74) *Attorney, Agent, or Firm* — Cantor Colburn LLP

(57) ABSTRACT

An electromagnetic relay including a contact switching unit having a pair of contacts. An electromagnet block drives the contact switching unit to open and close the contacts. An arc-extinguishing member includes a connection member and permanent magnets. The connection member is formed by connecting, via a middle part, opposing walls arranged in a direction perpendicular to the touch/separation direction of the contacts. Permanent magnets are disposed on opposing sections of the opposing walls.

9 Claims, 13 Drawing Sheets

(51) Int. Cl.
*H01H 9/44* (2006.01)
*H01H 50/24* (2006.01)

(56) References Cited

U.S. PATENT DOCUMENTS

| | | | | | |
|---|---|---|---|---|---|
| 3,800,250 | A | * | 3/1974 | Mori et al. | 335/128 |
| 4,302,742 | A | * | 11/1981 | Schedele | 335/202 |
| 4,367,448 | A | * | 1/1983 | Nishizako | 335/201 |
| 4,618,842 | A | * | 10/1986 | Nestlen et al. | 335/128 |
| 4,758,809 | A | * | 7/1988 | Bell | 335/128 |
| 4,761,627 | A | * | 8/1988 | Bell | 335/128 |
| 4,825,179 | A | * | 4/1989 | Nagamoto et al. | 335/80 |
| 4,958,137 | A | * | 9/1990 | Schroeder | 335/128 |
| 5,017,898 | A | * | 5/1991 | Kuzukawa | 335/128 |
| 5,041,870 | A | | 8/1991 | Imai et al. | |
| 5,109,146 | A | * | 4/1992 | Maenishi | 218/26 |
| 5,160,910 | A | * | 11/1992 | Tsuji | 335/129 |
| 5,202,663 | A | * | 4/1993 | Tomono et al. | 335/86 |
| 5,204,647 | A | * | 4/1993 | Mitsuki et al. | 335/80 |
| 5,289,144 | A | * | 2/1994 | Liao | 335/78 |
| 5,321,377 | A | * | 6/1994 | Aharonian | 335/78 |
| 5,392,015 | A | * | 2/1995 | Matsuoka et al. | 335/78 |
| 5,396,204 | A | * | 3/1995 | Matsuoka et al. | 335/78 |
| 5,416,455 | A | | 5/1995 | Moldovan | |
| 5,568,108 | A | * | 10/1996 | Kirsch | 335/130 |
| 5,572,176 | A | * | 11/1996 | Heinzl et al. | 335/129 |
| 5,680,082 | A | * | 10/1997 | Stocklin | 335/128 |
| 5,757,255 | A | * | 5/1998 | Noda et al. | 335/78 |
| 5,805,040 | A | * | 9/1998 | Corcoran | 335/202 |
| 5,808,533 | A | | 9/1998 | Buscher et al. | |
| 5,864,270 | A | * | 1/1999 | Hoffman | 335/78 |
| 5,907,268 | A | * | 5/1999 | Mader | 335/202 |
| 5,969,586 | A | * | 10/1999 | Noda et al. | 335/83 |
| 6,034,582 | A | * | 3/2000 | Fausch | 335/78 |
| 6,323,747 | B1 | * | 11/2001 | Mader et al. | 335/80 |
| 6,486,760 | B2 | * | 11/2002 | Miyazaki et al. | 335/78 |
| 6,606,018 | B2 | * | 8/2003 | Takano et al. | 335/78 |
| 6,731,190 | B2 | * | 5/2004 | Yamashita et al. | 335/78 |
| 6,903,638 | B2 | * | 6/2005 | Nakamura et al. | 335/78 |
| 7,205,870 | B2 | * | 4/2007 | Sanada et al. | 335/78 |
| 7,477,119 | B2 | * | 1/2009 | Wu | 335/83 |
| 7,750,769 | B2 | * | 7/2010 | Minowa et al. | 335/78 |
| 7,782,162 | B2 | * | 8/2010 | Nishida | 335/201 |
| 7,859,371 | B2 | * | 12/2010 | Takano | 335/78 |
| 7,994,884 | B2 | * | 8/2011 | Kuo | 335/78 |
| 8,111,117 | B2 | * | 2/2012 | Minowa et al. | 335/78 |
| 8,193,881 | B2 | * | 6/2012 | Yuba et al. | 335/78 |
| 2003/0231090 | A1 | * | 12/2003 | Copper et al. | 335/128 |
| 2005/0057332 | A1 | * | 3/2005 | Nakamura et al. | 335/128 |
| 2006/0279384 | A1 | * | 12/2006 | Takayama et al. | 335/78 |
| 2009/0134962 | A1 | * | 5/2009 | Nishida | 335/207 |
| 2009/0322453 | A1 | * | 12/2009 | Kawaguchi et al. | 335/81 |
| 2013/0113581 | A1 | * | 5/2013 | Kakimoto et al. | 335/196 |

FOREIGN PATENT DOCUMENTS

| | | | |
|---|---|---|---|
| EP | 2267746 | A1 | 12/2010 |
| JP | 5511064 | Y | 1/1980 |
| JP | 60107551 | Y | 7/1985 |
| JP | 2126344 | Y | 10/1990 |
| JP | 9512948 | W | 12/1997 |
| JP | 10154448 | A | 6/1998 |

OTHER PUBLICATIONS

Extended European Search Report for corresponding application EP11860930; Dated Sep. 29, 2014.

* cited by examiner

ELECTROMAGNETIC RELAY

CROSS REFERENCE TO RELATED APPLICATION

This application is a U.S. National Phase application under 35 U.S.C. §371 of International Application No. PCT/JP2011/057282, filed on Mar. 25, 2011 and claims benefit of priority to Japanese Patent Application Nos. 2011-055721, 2011-055725 and 2011-056915 filed on Mar. 14, 2011, Mar. 14, 2011 and Mar. 15, 2011 respectively of which the full contents are herein incorporated by reference.

BACKGROUND OF THE INVENTION

The present invention relates to an electromagnetic relay.

Conventionally, an electromagnetic relay in which an electromagnet block formed by winding a coil around an iron core with a spool interposed therebetween is magnetized or demagnetized to pivot a moving iron, which is supported pivotably by a yoke swaged and anchored to the iron core, and to drive a movable touch piece so that a movable contact opens and closes with respect to a fixed contact of a fixed touch piece arranged facing the movable touch piece is known (see e.g., Patent Document 1).

In this electromagnetic relay, a permanent magnet is arranged on an upper side of a contact switching unit to generate a magnetic field between the contacts so that when an arc current generates at the time of opening/closing of contact, the arc current can be extended toward the side and extinguished at an early stage.

Further, in the aforesaid convention electromagnetic relay, the magnetic field is generated by a single permanent magnet arranged on the upper side of the contact switching unit. The magnetic field is generated downward from a N pole (lower side) of the permanent magnet and is directed between the contacts toward the side, and thereafter directed towards the upper side, along each touch piece, to reach a S pole (upper side) of the permanent magnet. However, there is a problem that the magnetic flux easily leaks to the peripheral space and cannot be concentrated at the contact switching unit. As a result, the permanent magnet exerts a strong magnetic force which becomes necessary, which leads to higher cost.

Patent Document 1: Japanese Unexamined Patent Publication No. 2009-87918

SUMMARY OF THE INVENTION

Accordingly, the present invention provides a small and inexpensive electromagnetic relay having an arc extinguishing function capable of extinguishing an arc generated at the time of opening/closing of the contact at an early stage.

In accordance with one aspect of the present invention, the present invention provides an electromagnetic relay comprising:

a contact switching unit having a contact group which includes a pair of contacts in order to touch and separate;

an electromagnet block which drives the contact switching unit to open and close the contacts; and an arc extinguishing member having a connection member and permanent magnets, wherein the connection member is formed by connecting, via a middle part, opposing walls arranged in a direction perpendicular to the touch/separation direction of the contacts and the permanent magnets are disposed on opposing sections of the opposing walls.

In accordance with one of the preferred embodiments of the present invention, the electromagnetic relay comprising:

a base block on which the contact switching unit and the electromagnet block are mounted, and a case which is attached to the base block in order to cover the contact switching unit and the electromagnet block, wherein the case includes a recessed portion over which the opposing walls and the permanent magnets of the arc extinguishing member can be arranged.

Preferably, a polarity of an opposing surface of each permanent magnet and a direction in which an arc current generated at a time of opening/closing of the contact flows are determined. Thereafter a force displacing towards the middle part of the connection member is generated on the arc current.

In accordance with another embodiment of the present invention, the contact switching unit comprises of a pair of movable touch pieces, a pair of fixed touch pieces, wherein one of the fixed contact faces a movable contact of one of the movable touch piece in order to touch and separate in accordance with the movable contact; and a connection terminal which electrically connects one of the movable touch piece and one of the fixed touch piece.

In accordance with yet another embodiment of the present invention, the base block is preferably configured with a first base section having the touch pieces and the electromagnet block, and a second base section having tab terminals connected to the touch pieces and coil terminals of the electromagnet block respectively.

BRIEF DESCRIPTION OF THE DRAWINGS

The invention will become more readily appreciated and understood from the following detailed description of preferred embodiments of the invention when taken in conjunction with the accompanying drawings, in which.

(a) is a perspective view showing a state in which a first base section is seen from an upper side, and (b) is a perspective view showing a state in which the first base section is seen from a lower side.

Figure 6:
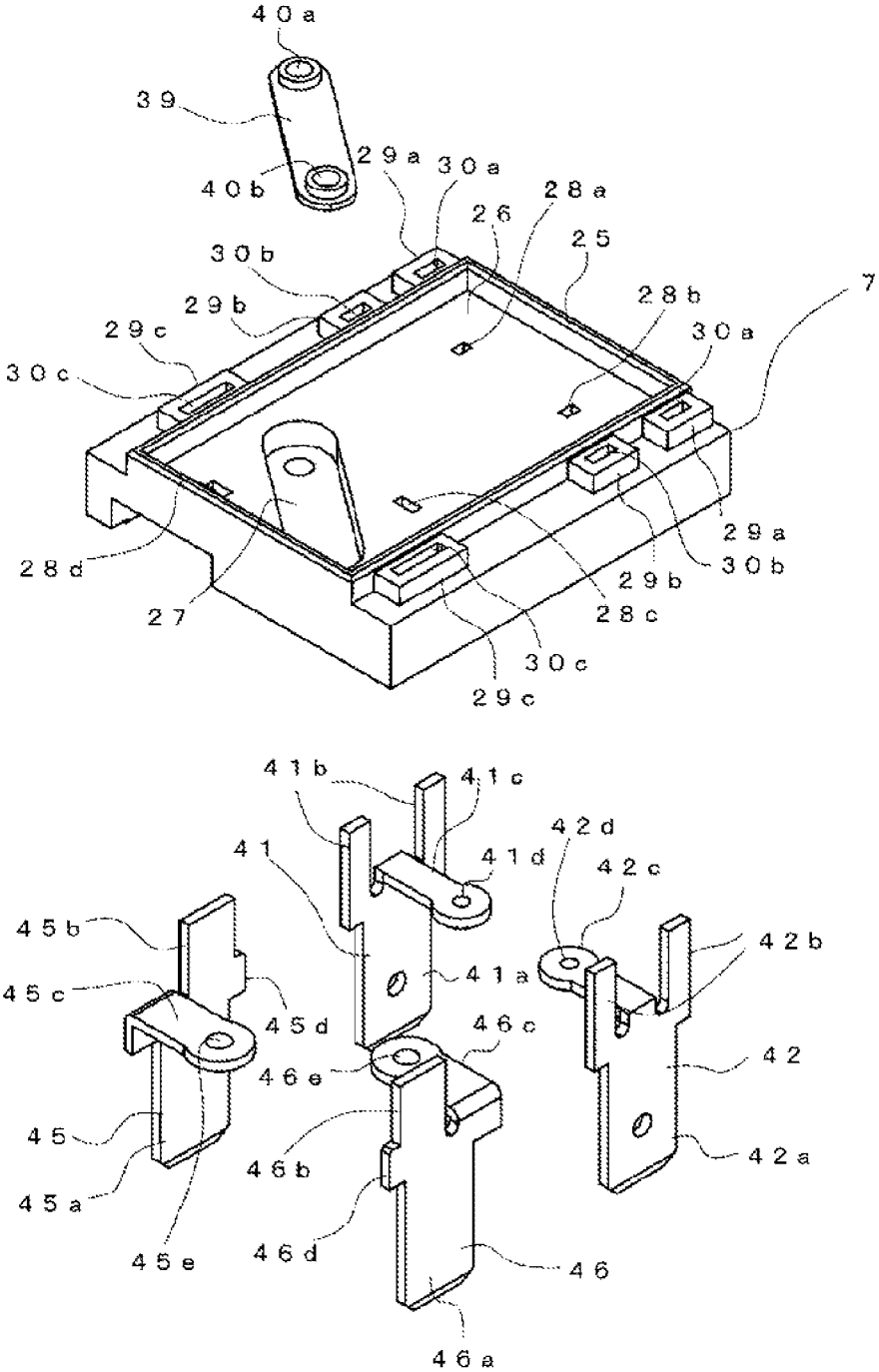

FIG. 6 is an exploded perspective view of a second base section and a tab terminal.

Figure 7:
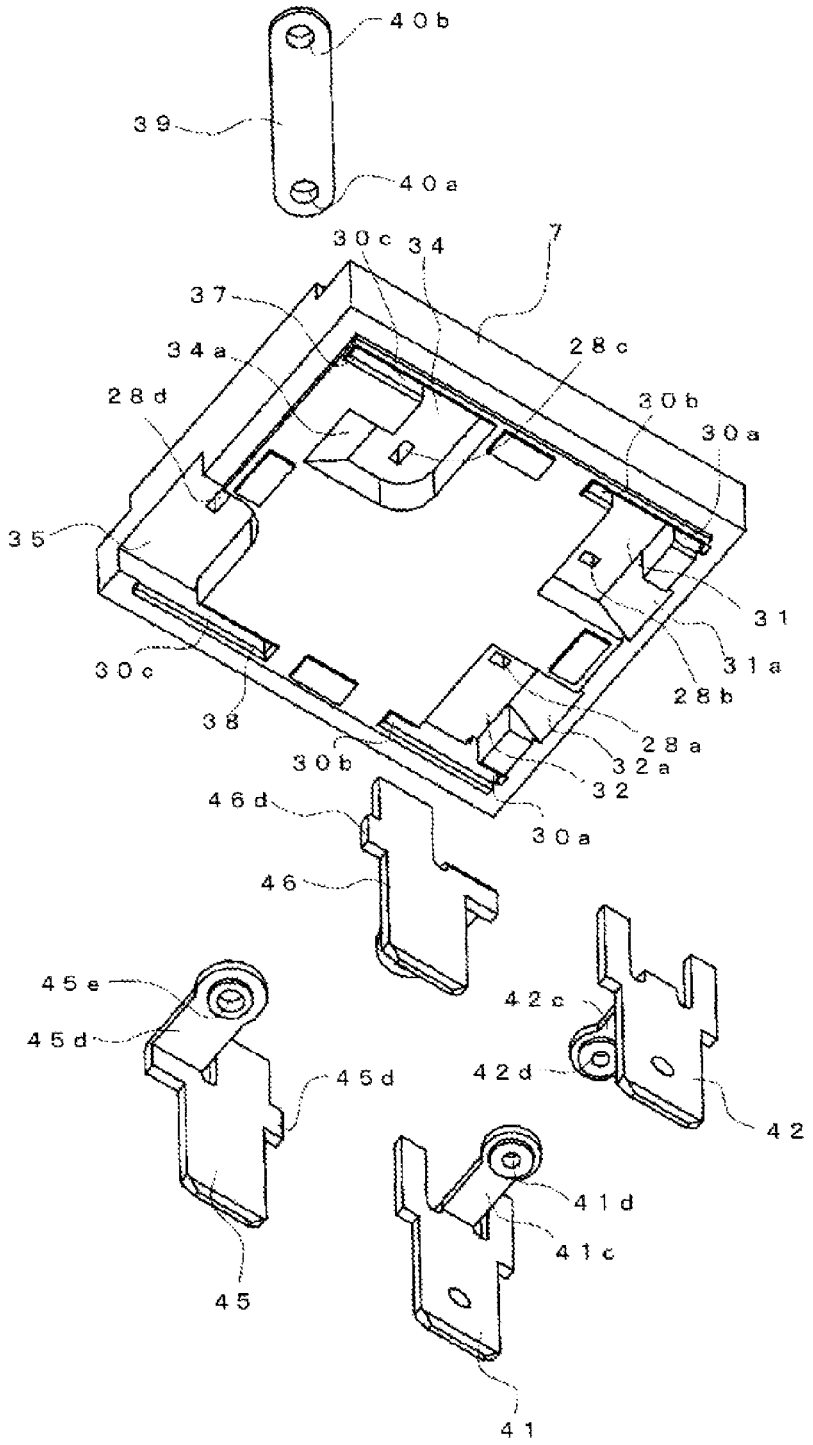

FIG. 7 is a perspective view of a state in which FIG. 6 is seen from the lower side.

Figure 8:
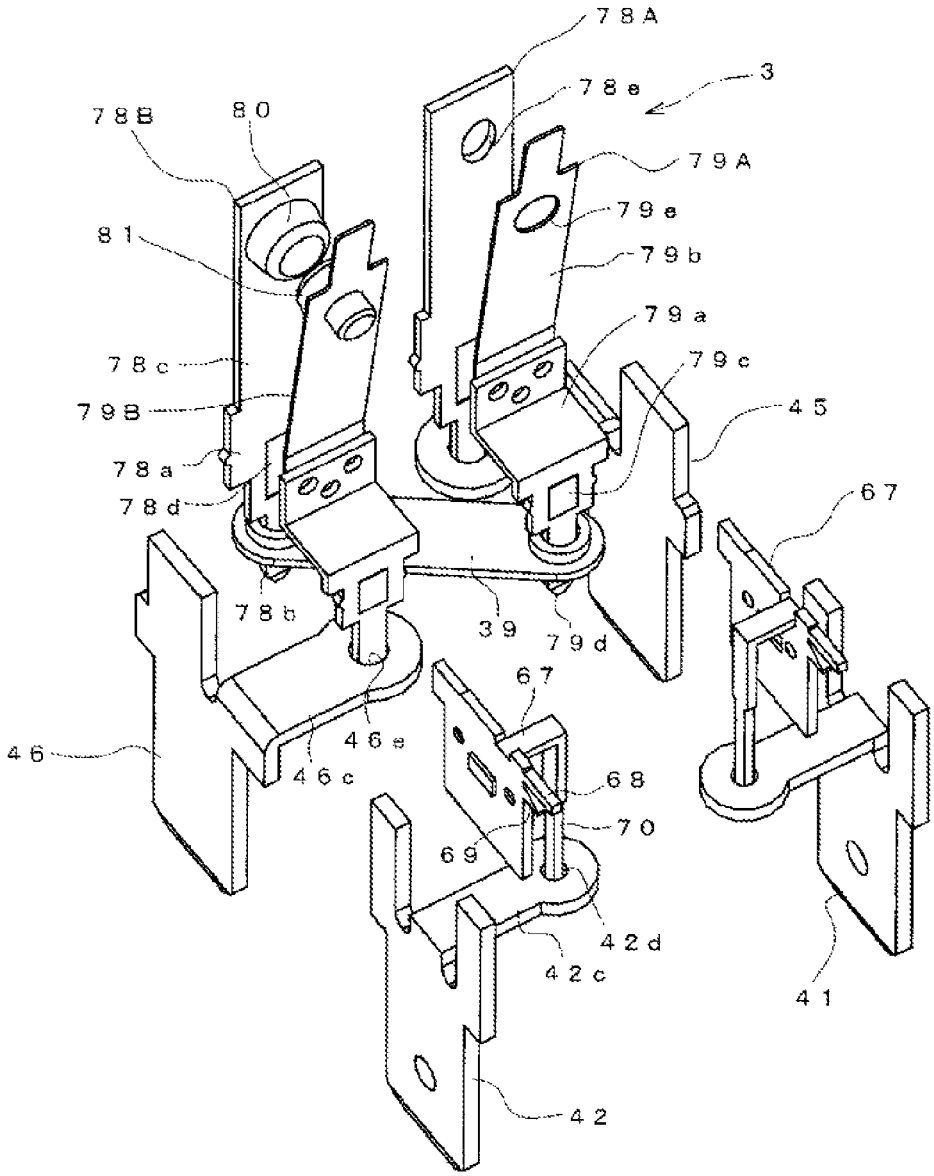

FIG. 8 is a perspective view of a connection state of a movable touch piece, a fixed touch piece, a coil terminal, a connection terminal, and a tab terminal.

Figure 2:
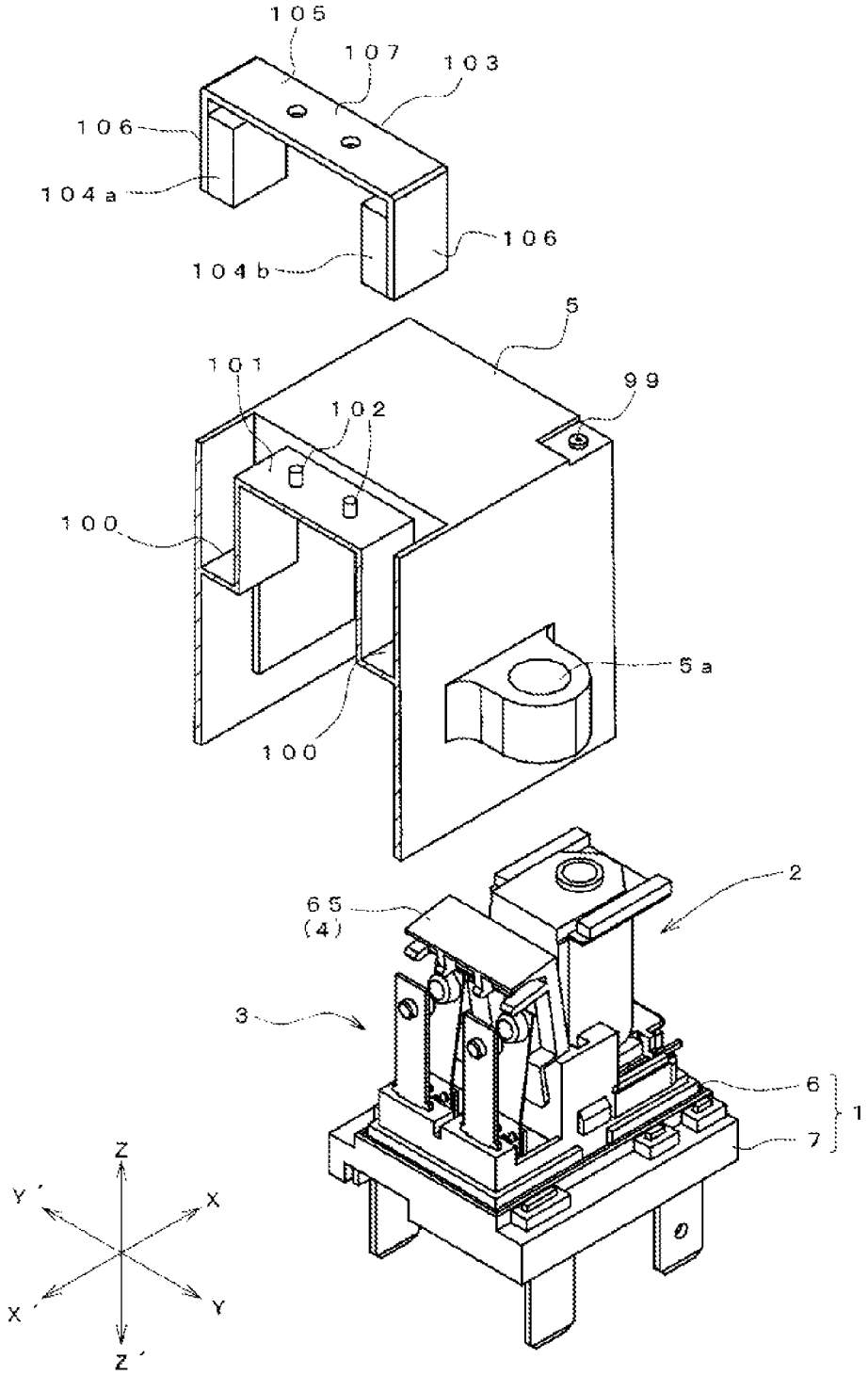
FIG. 2 is a perspective view of a state in which a case and an arc extinguishing member are exploded from FIG. 1.
Figure 3:
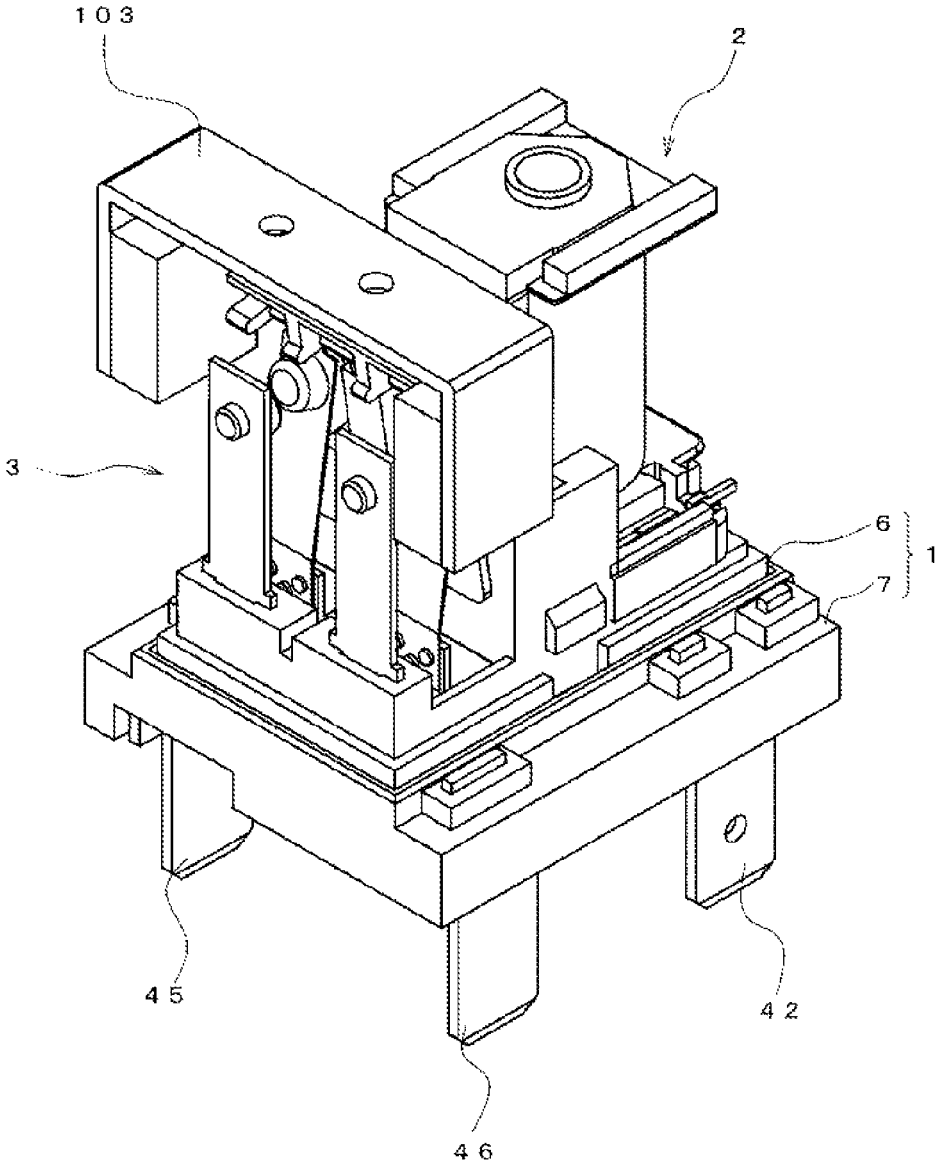
FIG. 3 is a perspective view of a state in which only the case is removed from FIG. 1.
Figure 9:
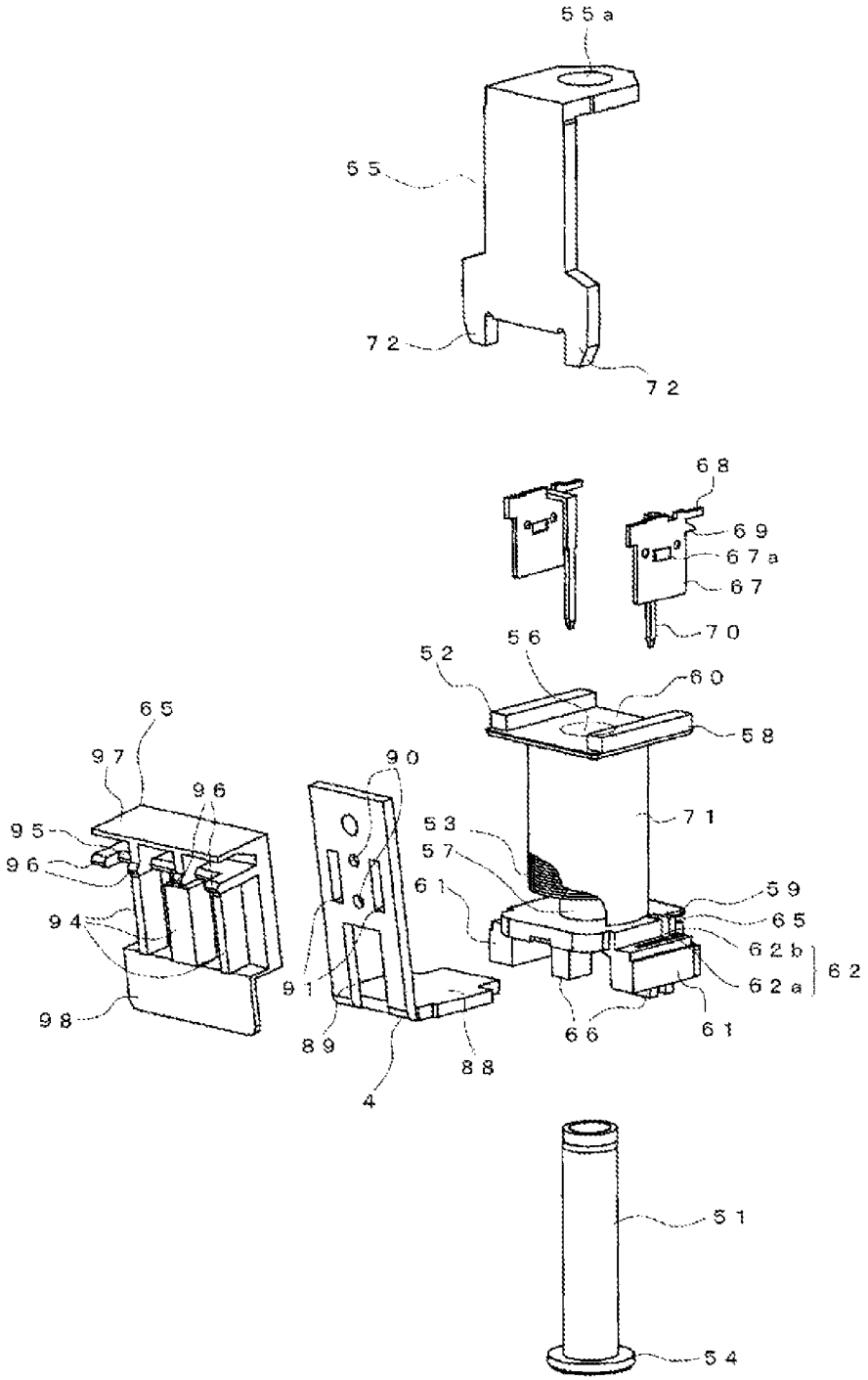

FIG. 9 is an exploded perspective view of an electromagnet block and a moving iron as shown in FIG. 2.

Figure 10:
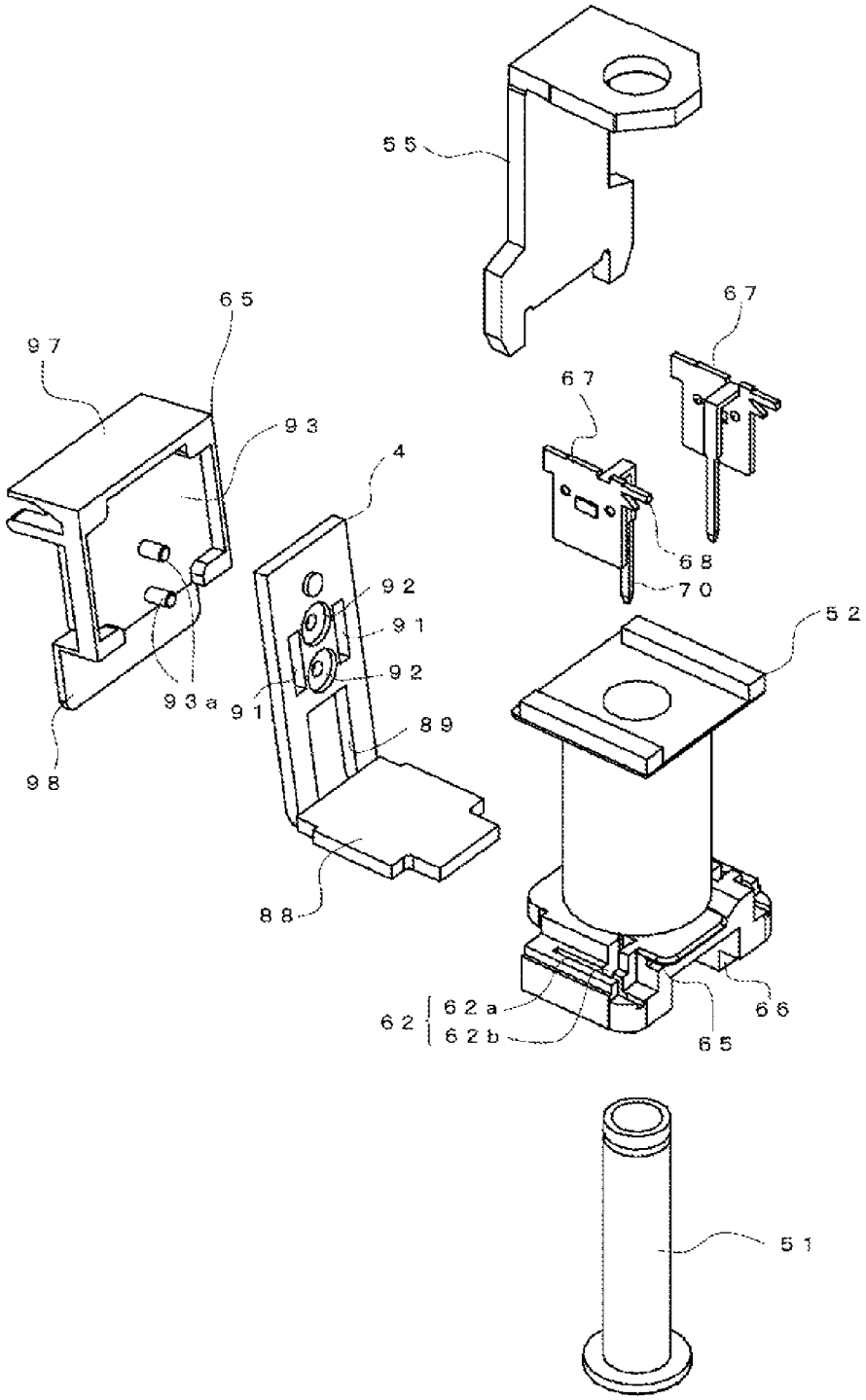

FIG. 10 is a perspective view of a state in which FIG. 9 is seen from the opposite side.

Figure 11:
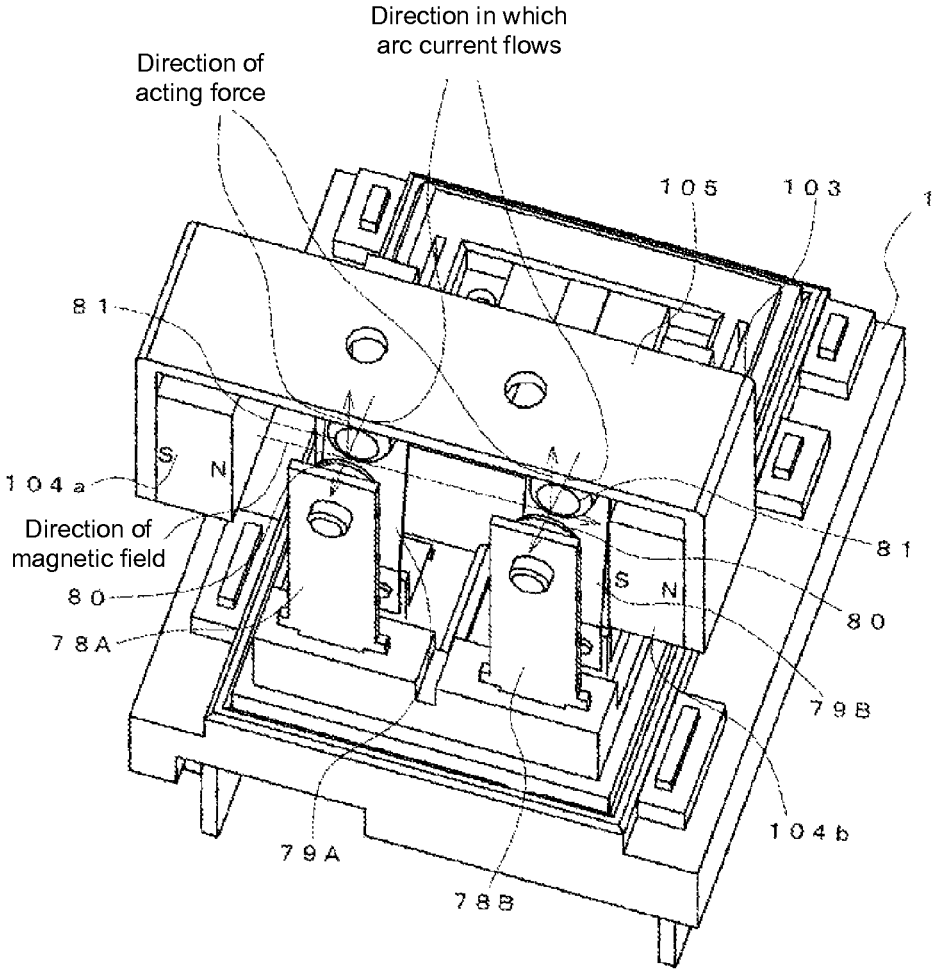

FIG. 11 is a partial perspective view of a relationship of arc current, direction of magnetic field, and force acting on arc current.

Figure 1:
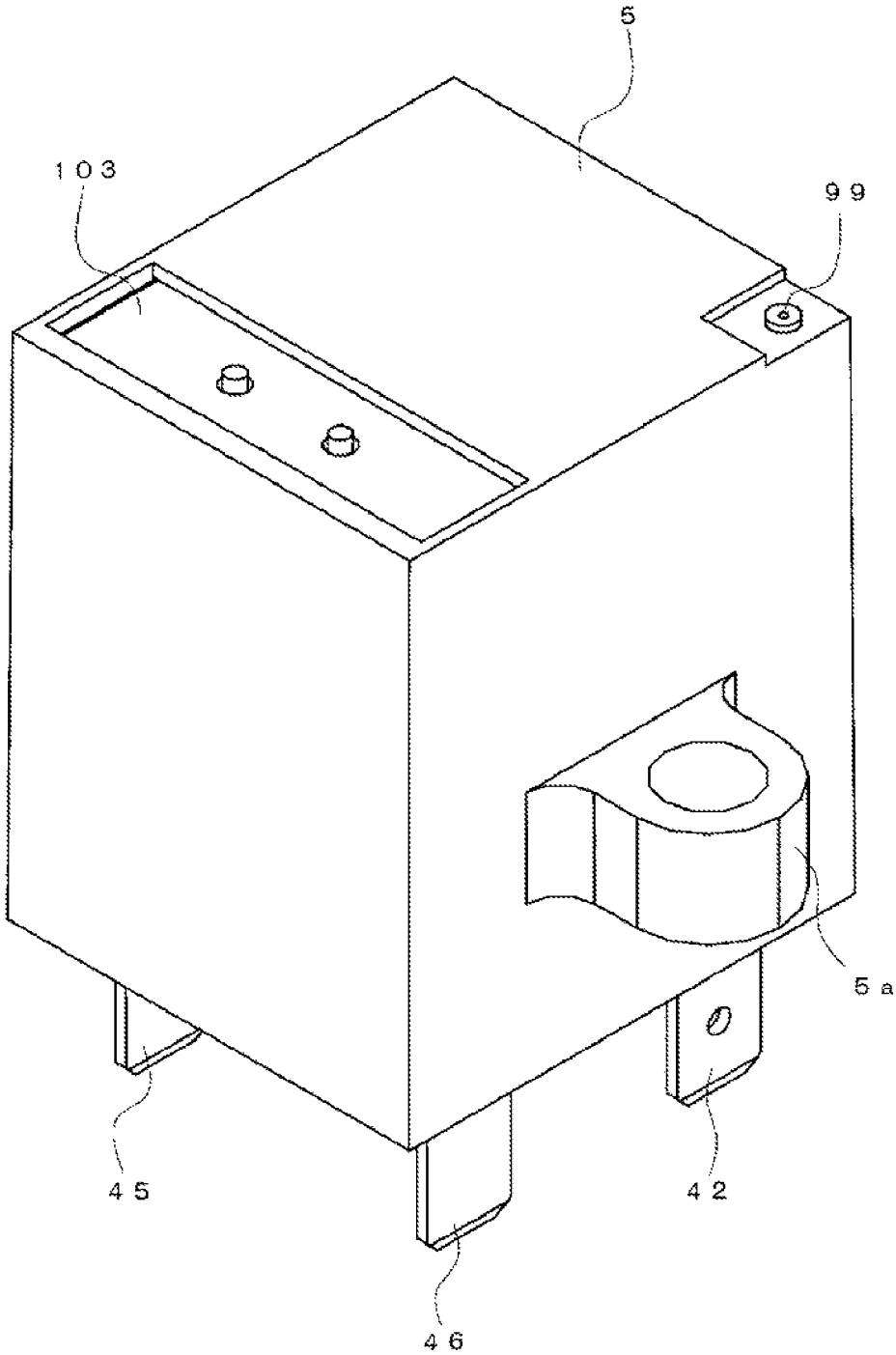
FIG. 1 is a perspective view of an electromagnetic relay according to the one of the preferred embodiments of the present invention.
Figure 12:
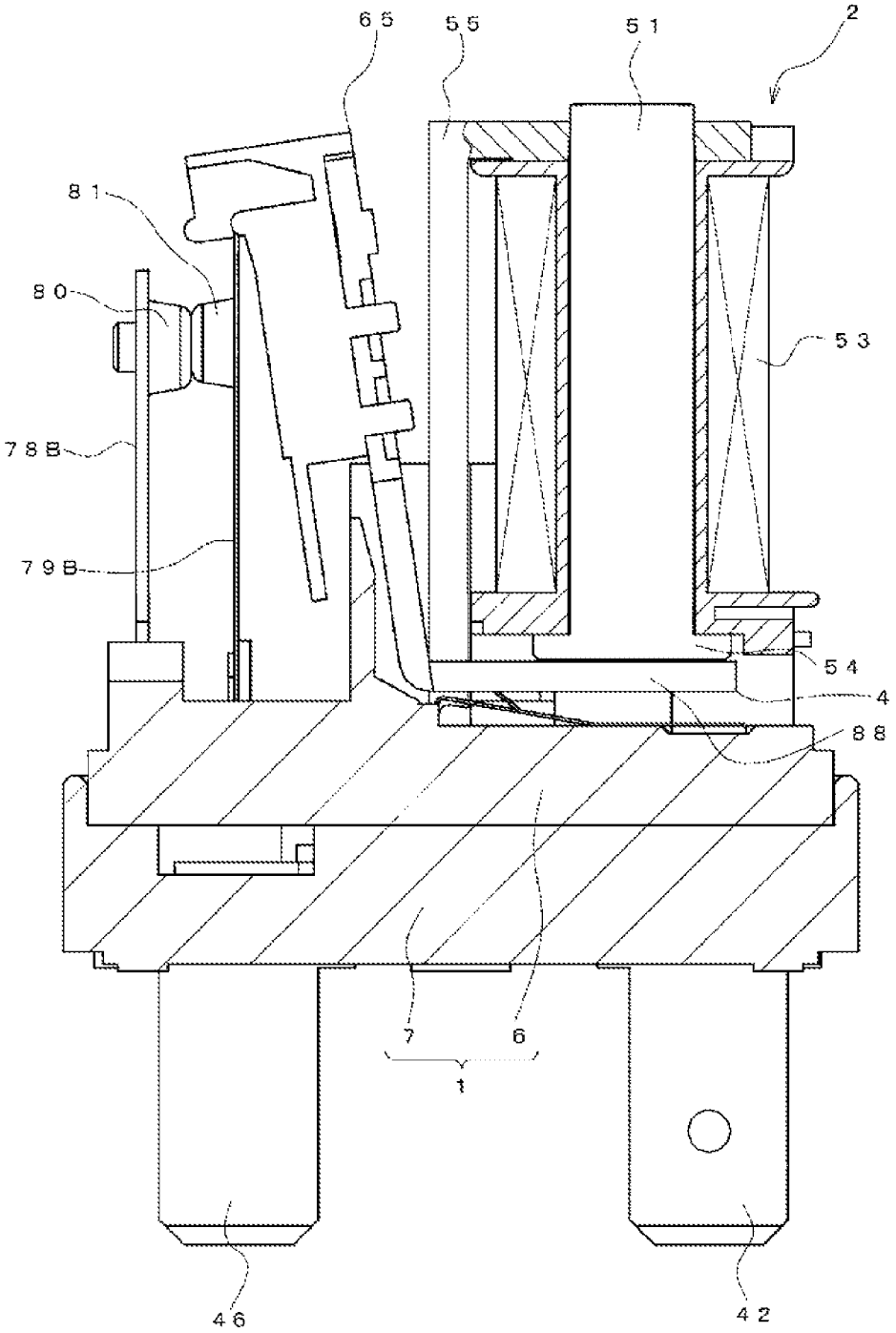

FIG. 12 is a cross-sectional view at the time of contact closing showing a state in which the case is removed from FIG. 1.

Figure 13:
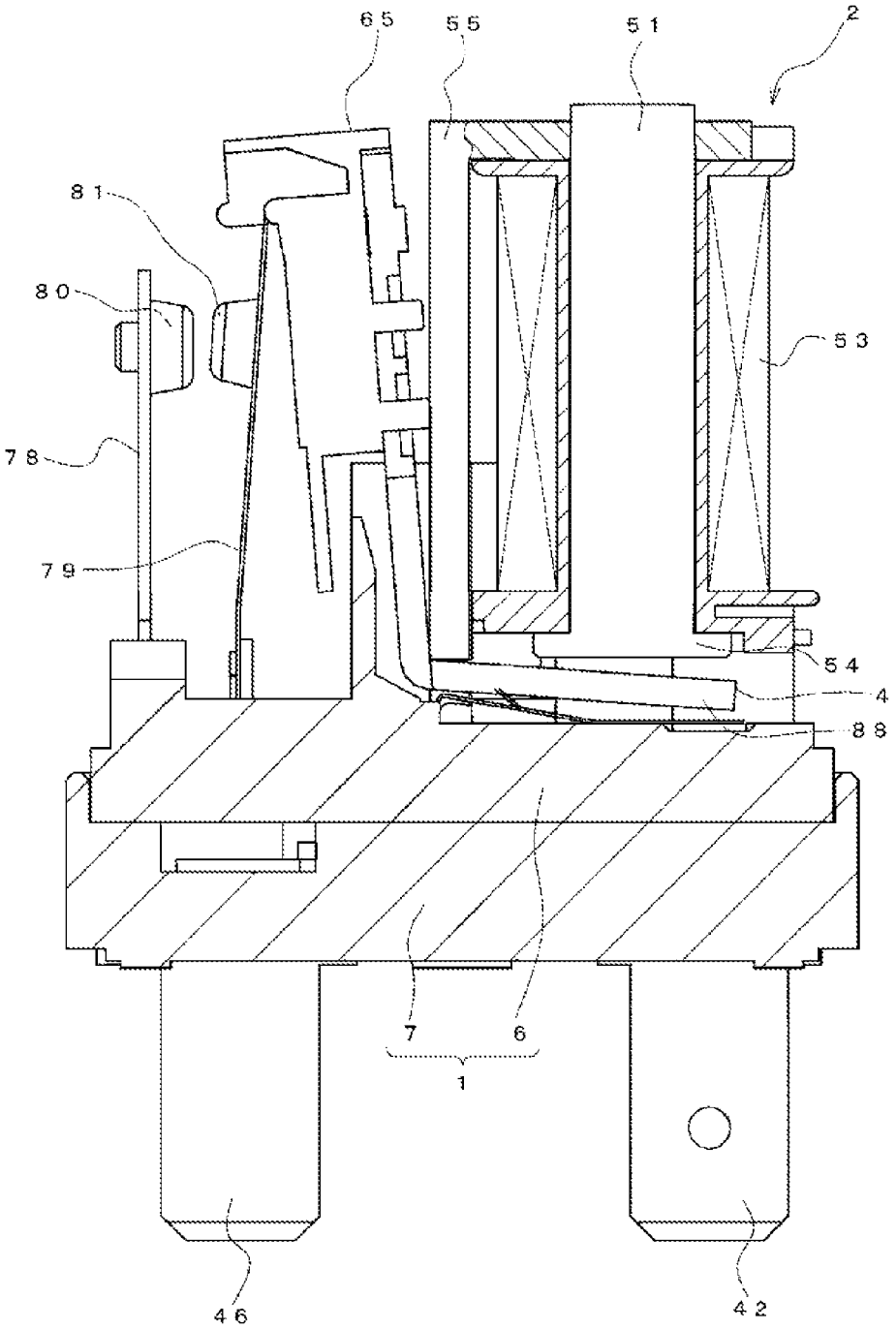

FIG. 13 is a cross-sectional view at the time of contact opening showing a state in which the case is removed from FIG. 1.

DETAILED DESCRIPTION

An embodiment according to the present invention will be hereinafter described according to the accompanying drawings. In the following description, terms (e.g., terms including "up", "down", "side", "end") indicating a specific direction or position are used as necessary but the use of the terms are merely to facilitate the understanding of the invention that references the drawings, and it should be recognized that the technical scope of the invention is not to be limited by the meaning of the terms. Furthermore, the following description is merely illustrative in essence, and is not intended to limit the present invention nor the applied articles or the applications thereof.

FIGS. 1 to 4 show an electromagnetic relay according to the one of the preferred embodiments of the present invention. The electromagnetic relay is obtained by arranging an electromagnet block 2, a contact switching unit 3, and a moving iron 4 on a base block 1 and placing a case 5 thereon.

As shown in FIG. 2, the base block 1 is configured with a first base section 6 and a second base section 7. (Hereinafter, description will be made with a direction extending in a longitudinal direction along a long side assumed as an X axis, a direction extending in a short-side direction along a short-side assumed as a Y axis, and a direction extending in a height direction as a Z axis.)

Figure 5:
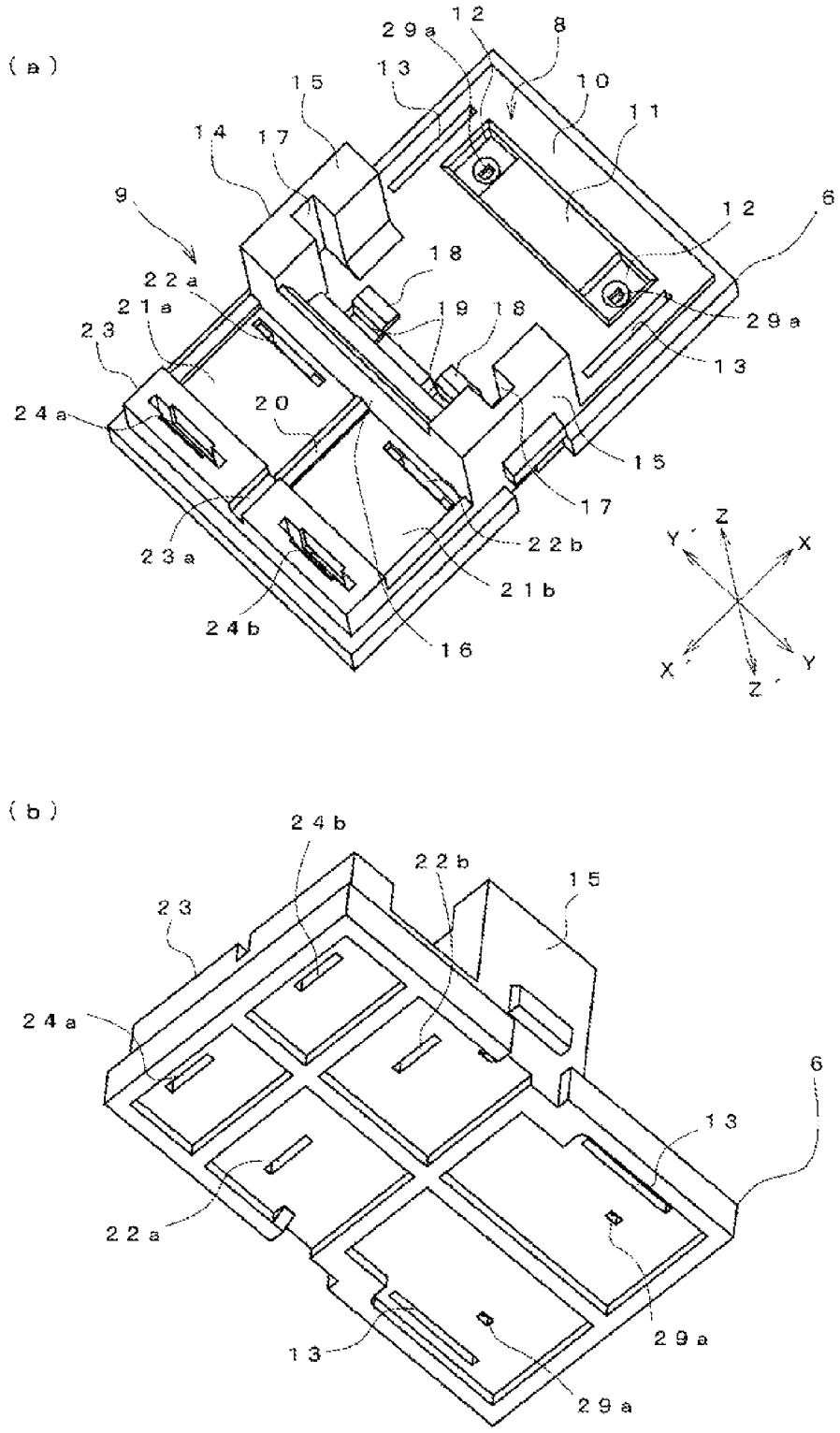
FIG. 5

As shown in FIG. 5, the first base section 6 is formed into a rectangular shape in a plan view by a forming process on a synthetic resin material, and has a first attachment section 8 and a second attachment section 9 lined at two areas in a longitudinal direction (XX') direction.

The first attachment section 8 is provided to attach the electromagnet block 2, to be described later, and is formed with a base portion 10 bulging out toward the upper side excluding a peripheral edge portion. A recessed area 11 extending in a short-side direction (YY' direction) is formed at one end side (X direction side) of the base portion 10. A deeper positioning recessed portion 12 is formed at both ends of the recessed area 11. A guide projection 66 formed on a spool 52 of the electromagnet block 2, to be described later, is positioned in the positioning recessed portion 12. On a bottom surface of the positioning recessed portion 12 is formed a through-hole 29*a* to which a connection terminal portion 70 of the coil terminal 67 is inserted. A coil terminal hole 13 that extends in the longitudinal direction (XX' direction) and passes through the upper and lower surfaces is formed on both sides of the recessed area 11 (near the outer side of each positioning recessed portion 12).

A guide portion 14 is formed at a boundary to the second attachment section 9 in a central portion of the first base section 6. The guide portion 14 is configured with a pair of guide walls 15 arranged facing each other in the short-side direction (YY' direction), and an insulating wall 16 that connects the guide walls. A guide groove 17 extending in an up and down direction is formed on each opposing surface of the guide walls 15. The guide grooves 17 guide both side parts of a yoke 55, to be described later. In a region surrounded by the guide walls 15 and the insulating wall 16 is formed a pair of protrusions 18 and recessed portions 19 at a predetermined interval in the short-side direction (YY' direction). The protrusions 18 and the recessed portions 19 guide a hinge spring.

The second attachment section 9 is provided to attach the contact switching unit 3, and is formed with recessed portions 21*a*, 21*b* partitioned in the short-side direction (YY' direction) by a projected thread section 20. Slit-like first terminal holes 22*a*, 22*b* are formed along the guide wall 15 so as to open at the upper and lower surfaces in the recessed portions 21*a*, 21*b*. Each of the first terminal holes 22*a*, 22*b* is to be press-fitted with a movable touch piece 79, to be described later. The second attachment section 9 has a thick-walled portion 23 formed at one end side (X' direction side). The thick-walled portion 23 includes a groove 23*a* extending in the longitudinal direction (XX' direction) at a central part, and slit-like second terminal holes 24*a*, 24*b* formed along the short-side direction (YY' direction) at respective portions divided in half so as to open at the upper and lower surfaces. Each of the second terminal holes 24*a*, 24*b* is to be press-fitted and fixed with a fixed touch piece 78, to be described later.

As shown in FIG. 6, the second base section 7 is formed into a rectangular shape in plan view by a forming process on a synthetic resin material, similar to the first base section 6. A rectangular recessed area 26 surrounded by a peripheral wall 25 is formed on the upper surface of the second base section 7, and a lower surface portion of the first base section 6 is to be mounted thereon. An elongate recessed portion 27 for arranging a connection terminal 39, and four through-holes 28*a* to 28*d* are formed in the rectangular recessed area 26.

According to the configuration, the connecting position can be freely set with the tab terminal by simply adding the second base section even if the portion configured with other components already exists.

The connection terminal portion 70 of the coil terminal 67 is inserted to the two through-holes 28*a*, 28*b*, and a terminal portion 79*d* of one movable touch piece 79 and a terminal portion 78*b* of one fixed touch piece 78 are respectively inserted to the remaining two through-holes 28*c*, 28*d*. Three projections 29*a*, 29*b*, 29*c* are formed along an outer surface of the peripheral wall 25 at both side parts of the second base section 7. The projections 29*a*, 29*b*, 29*c* are formed with press-fitting holes 30*a*, 30*b*, and 30*c*, respectively. A press-fit portion 41*b* of a first tab terminal 41 and a press-fit portion 42*b* of a second tab terminal 42 are respectively press-fitted to the two press-fitting holes 30*a*, 30*b* on both sides, and a press-fit portion 45*b* of a third tab terminal 46 and a press-fit portion 46*b* of a fourth tab terminal 45 are press-fitted to the remaining one press-fitting hole 30*c*.

According to the configuration, the configuration of the electric path can be freely changed with a simple configuration of simply adding the connection terminal.

As shown in FIG. 7, on a bottom surface of the second base section 7 is formed four recessed portions (first recessed portion 31, second recessed portion 32, third recessed portion 34, and fourth recessed portion 35) at the positions corresponding to the through-holes 28*a* to 28*d*.

Two recessed portions (the first recessed portion 31 and the second recessed portion 32) are for the first tab terminal 41 and for the second tab terminal 42 which are connected to the coil terminals 67. The two press-fitting holes 30*a*, 30*b* are opened along a side edge portion on both sides of one end of the first recessed portion 31 and the second recessed portion 32, and the through-holes 28*a*, 28*b*, from each of which the connection terminal portion 70 of the coil terminal 67 projects out, are opened at the central part of the other end. At one part of an inner side surface of a vicinity portion of the through-holes 28*a*, 28*b*, inclined surfaces 31*a*, 32*a* that gradually become deeper from a side edge portion of the second base section 7 are formed.

The third recessed portion 34 is for the third tab terminal 46 connected to the movable touch piece 79, and the fourth recessed portion 35 is for the fourth tab terminal 45 connected to the fixed touch piece 78.

The press-fitting hole 30*c* is opened at the side of one end of the third recessed portion 34, and the press-fit portion 46*b* of the third tab terminal 46 is press-fitted thereto. In continuation to the press-fitting hole 30*c* is formed a slit-like guide recessed portion 37 to which a stopper 46*d* of the third tab terminal 46 comes into contact. The through-hole 28*c*, to which the terminal portion 79*d* of one movable touch piece 79B is inserted, is opened at the central part on the other end side of the third recessed portion 34. An inclined surface 34*a* is formed at one part of the inner side surface in the vicinity of the through-hole 28*c*.

The press-fitting hole 30*c*, to which the press-fit portion 45*d* of the fourth tab terminal 45 is press-fitted, is opened at the side of one end of the fourth recessed portion 35. Similar to the description made above, a slit-like guide recessed portion 38 to which a stopper 45*d* of the fourth tab terminal 45 comes into contact is formed in continuation to the press-fitting hole 30*d*. The through-hole 28*d*, to which the terminal portion 78*b* of one fixed touch piece 78A is inserted, is opened at the central part on the other end side of the fourth recessed portion 35. One part of the fourth recessed portion 35 is opened at the side surface of the second base section 7.

The connection terminal 39 is made from a conductive plate material having the ends formed into an arcuate shape, and has through-holes 40*a*, 40*b* formed at the respective ends. The terminal portion 79*d* of the remaining other movable touch piece 79A and the terminal portion 78*b* of the remaining other fixed touch piece 78B are respectively inserted to the through-holes 40*a*, 40*b*, and electrically connected to each other by soldering.

As shown in FIG. 6, the first tab terminal 41 and the second tab terminal 42 are formed into a plate-shape with a conductive material, and are configured with terminal portions 41*a*, 42*a*, and connecting portions 41*c*, 42*c* bent at right angle with respect to the terminal portions 41*a*, 42*a* between the pair of press-fit portions 41*b*, 42*b* projecting out from the respective sides of the upper edge. The press-fit portions 41*b*, 42*b* are press-fitted to the press-fitting holes 30*a*, 30*b* of the second base section 7, and the first tab terminal 41 is fixed to the second base section 7. Each leading end portion of the connecting portions 41*c*, 42*c* has a circular plate shape, and has through-holes 41*d*, 42*d* formed at the center thereof. The connection terminal portions 70 of the coil terminal 67 are inserted to the through-holes 41*d*, 42*d* and electrically connected to each other by soldering.

The third tab terminal 46 and the fourth tab terminal 45 are formed into a plate-shape with a conductive material, and are configured with terminal portions 45*a*, 46*a*, press-fit portions 45*b*, 46*b* projecting out with the width narrowing from the upper edge, connecting portions 45*c*, 46*c* bent at right angle from the upper edge, and stoppers 45*d*, 46*d* projecting out toward the side opposite to the connecting portions 45*c*, 46*c*. The press-fit portions 45*b*, 46*b* are press-fitted to the press-fitting hole 30*c* of the second base, and the third tab terminal 46 and the fourth end terminal 46 are fixed to the second base section 7. Each leading end portion of the connecting portions 45*c*, 46*c* has a circular plate shape, and has through-holes 45*e*, 46*e* formed at the center thereof. The terminal portion 79*d* of one movable touch piece 79B and the terminal portion 78*b* of one fixed touch piece 78A are inserted to the through-holes 45*e*, 46*e*, respectively, and electrically connected to each other by soldering. The stoppers 45*d*, 46*d* are positioned while making contact with the bottom surface of the guide recessed portions 37, 38 continuing to the press-fitting hole 30*c*.

As shown in FIGS. 9 and 10, the electromagnet block 2 is formed by winding a coil 53 around an iron core 51 with a spool 52 interposed therebetween.

The iron core 51 is formed into a rod-shape with a magnetic material, where a guard shaped magnet pole section 54 is formed at a lower end section and a yoke 55 is swaged and anchored at an upper end section.

The spool 52 is obtained by a forming process on a synthetic resin material, and is configured with a tubular body portion 57 that forms a center hole 56, and guard portions (upper end guard portion 58 and lower end guard portion 59) formed on both upper and lower end sections.

The upper end guard portion 58 has an escape groove 60 formed at the upper surface, and the center hole 56 is opened thereat. One end section of the yoke 55, to be described later, is arranged in the escape groove 60. The center hole 56 is opened at the lower end guard portion 59, so that the iron core 51 can be inserted therefrom.

A terminal attachment portion 61 projecting out downward is formed on both side parts of the lower end guard portion 59, to form a groove portion with the bottom surface of the lower end guard portion 59. A terminal holding hole 62 is formed at each terminal attachment portion 61. Each terminal holding hole 62 has a substantially T-shape in a cross-sectional view, and is configured with a terminal fixing portion 62*a* to which a press-fit bulging out portion 67*a* of the coil terminal 67, to be described, is press-fitted, and an escape portion 62*b* to which the connection terminal portion 70 is inserted. The coil winding portion 68 of the coil terminal 67 press-fitted and fixed in the terminal holding hole 62 projects out at the step portion on the upper side of each terminal attachment portion 61.

A guiding groove 65 communicating to the step portion on the upper side of one of the terminal attachment portions 61 is formed from the body portion 57 toward the side end face at the lower end guard portion 59. One end side (winding start side) of the coil 53 to be wound around the body portion 57 is arranged in the guiding groove 65, and is wound around the coil winding portion 68 of the coil terminal 67.

A pair of guide projections 66 is arranged at a predetermined interval on the bottom surface of the lower end guard portion 59. The guide projections 66 are positioned in the positioning recessed portion 12 of the first base section 6, to play a role of positioning the spool 52, that is, the electromagnet block 2 with respect to the base block 1.

The coil terminal 67 is formed into a flat plate shape with a conductive material, and the press-fit bulging out portion 67*a* that bulges out to the surface on the opposite side by press working is formed at the central part and both sides of the central part. The coil winding portion 68 that projects out in the horizontal direction from the upper end edge portion of the coil terminal 67 and an inclined projection 69 that projects out diagonally downward are also formed. The connection terminal portion 70 that projects out downward from the side projects out from the vicinity of the coil winding portion 68. The connection terminal portion 70 projects out from the lower end guard portion 59 of the spool 52.

The coil 53 is wound around the body portion 57 of the spool 52, and then an insulating sheet 71 is adhered to the outer peripheral surface. One end section of the coil 53 is arranged in the guiding groove 65 of the spool 52, and after being wound around the body portion 57 of the spool 52, both ends are respectively wound around the coil winding portion 68 of each coil terminal 67 and then soldered.

The yoke 55 is swaged and anchored to one end section of the iron core 51.

The yoke 55 is formed into a substantially L-shape by bending a magnetic material. One end section of the yoke 55 is formed with an opening 55*a* for inserting one end section of the iron core 51 and swaging and anchoring the same. The other end section of the yoke 55 has a wide width, and a projecting section 72 is formed on both sides of the lower end section. The moving iron 4, to be described later, is positioned between the projecting sections 72 and one corner functions as a fulcrum for pivotably supporting the moving iron 4.

Figure 4:
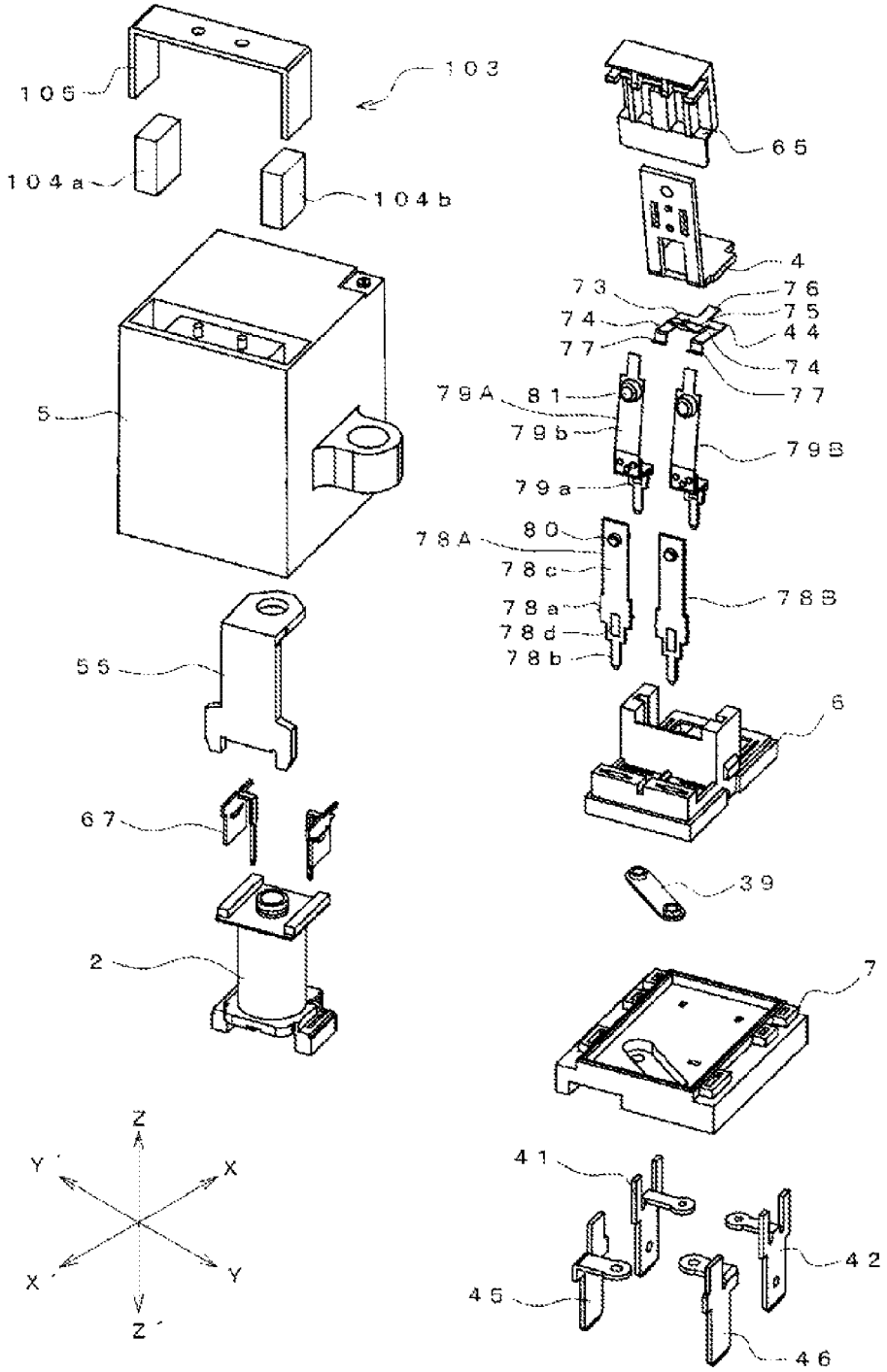
FIG. 4 is an exploded perspective view of FIG. 1.

As shown in FIG. 4, the hinge spring 44 is obtained by forming a plate-like spring material into a fork-shape, where a positioning arm portion 74 on both sides and an elastic support 75 at the central part project out to one side from the coupling portion 73. The guide portion 76 projects out to the side opposite to the elastic support 75 from the coupling portion 73. The positioning arm portion 74 is inclined gradually upward toward the leading end, where the leading end portion becomes a latching portion 77 that is bent so as to be directed downward and then directed diagonally upward. The latching portion 77 is positioned by the protrusion 18 and the recessed portion 19 formed on the upper surface of the first base section 6, and guides the pivoting fulcrum of the moving iron 4 from the lower side. The elastic support 75 is gradually directed diagonally upward from the coupling portion 73, and further bent toward the upper side from the middle part to pivotably support the moving iron 4. The guide portion 76 comes into contact with the lower surface of a section 88 to be drawn of the moving iron 4 to regulate the pivoting range of when spaced apart from the magnet pole section 54 of the iron core 51.

As shown in FIGS. 4 and 8, the contact switching unit 3 is configured with the fixed touch piece 78 and the movable touch piece 79 in which the conductive material such as copper is press worked to a plate shape.

The fixed touch piece 78 is configured with a press-fit portion 78*a*, a terminal portion 78*b* extending to the lower side from the press-fit portion 78*a*, and a touch piece portion 78*c* extending to the upper side from the press-fit portion 78*a*. The press-fit portion 78*a* is formed with a bulging out portion 78*d* that bulges out from one surface by press working. The second terminal holes 24*a*, 24*b* of the first base section 6 can be press-fitted by the bulging out portion 78*d*. A through-hole 78*e* is formed at the upper end of the touch piece portion 78*c*, and the fixed contact 80 is swaged and fixed thereat.

The movable touch piece 79 is configured with a press-fit portion 79*a*, and a touch piece portions 79*b* swaged and fixed to the press-fit portion 79*a* and extended upward. The press-fit portion 79*a* is bent into a crank shape, and the bulging out portion 79*c* is formed at the portion having a wide with, where the lower side thereof becomes a terminal portion 79*d* having a narrow width. The bulging out portion 79*c* is press-fitted to the terminal hole 22*a* of the first base section 6. The terminal portion 79*d* of one movable touch piece 79 is inserted to the through-hole 28*c* of the second base section 7 from the first base section 6 to be projected out into the third recessed portion 34, and the other terminal portion 79*d* is inserted to the through-hole 40*a* of the connection terminal 39. The touch piece portion 79*b* is formed to have a thin thickness compared to the press-fit portion 79*a* so as to be easily elastically deformed, and is bent from the vicinity portion of the press-fit portion 79*a* and extended diagonally. A through-hole 79*e* is formed at the upper end of the touch piece portion 79*b*, and the movable contact 81 is swaged and fixed thereat. The movable touch piece 79 faces the fixed contact 81 of the fixed touch piece 78 in which the movable contact 62 is press-fitted to the second terminal holes 24*a*, 24*b* to touch and separate therewith with the press-fit portion 79*a* press-fitted to the first terminal holes 22*a*, 22*b* of the first base section 6.

As shown in FIGS. 9 and 10, the moving iron 4 is formed into a substantially L-shape by press working a plate-like magnetic material. One end side of the moving iron 4 is the section 88 to be drawn that is drawn to the magnet pole section 54 of the iron core 51. The leading end portion and the base portion of the section 88 to be drawn have a narrow width, and the interference of the guide projection 66 formed on the bottom surface of the spool 52 and the projecting section 72 formed on the lower end section of the yoke 55 is avoided. An opening 89 is formed on the other end side of the moving iron 4. A through-hole 90 is formed at two areas in the upper portion of the opening 89 at the other end section of the moving iron 4, where a protrusion 93*a* of the card member 65 is thermally swaged and integrated therewith. A slit 91 is formed on both sides of the thermal swaging position, and provides a space that permits the deformation toward the side when forming the recessed portion 92 so that the resin does not run out in thermal swaging.

The card member 65 is made of a synthetic resin material, where a depressed portion 93 to be arranged with the upper end side of the moving iron 4 is formed on one surface. A protrusion 93*a* is formed at two upper and lower areas in the depressed portion 93, which is inserted to the through-hole 90 of the moving iron 4 and then used for thermal swaging. A first rib 94 having three columns and extending in the up and down direction, is formed on the other surface of the card member. The upper ends of the first ribs 94 are coupled to each other by a coupling wall 95, two right and left protrusions 96, which form a set, are formed from the front edge portion toward the front side. The upper end section of the movable touch piece 79 is guided to between each set of protrusions 18 to pressure contact the front end portion of the coupling wall 95. A first shielding wall 97 that projects out frontward is formed at the upper end section of the card member 65, and a second shielding wall 98 that projects out frontward and then extends downward is formed at the lower end section.

As shown in FIG. 2, the case 5 is made of a synthetic resin material and formed into a box-shape having an opened lower surface. A resin sealing hole 99 is formed at the corner of the upper surface of the case 5. The resin sealing hole 99 is thermally sealed after sealing the fitting portion of the base block 1 and the case 5. A slit-like recessed portion 100 is formed on both sides at the edge portion of the upper surface (side opposite to the resin sealing hole 99) of the case 5. A recessed area 101 that is depressed from the upper surface is formed between the recessed portions 100, and a protrusion 102 is formed at the central part of the respective upper surface. Here, 5*a* is an attachment portion for screw fixing the electromagnetic relay.

An arc extinguishing member 103 is attached to the case 5 using the recessed portion 100 and the recessed area 101.

The arc extinguishing member 103 is configured with a pair of permanent magnets 104*a*, 104*b* arranged at a predetermined interval to extinguish an arc, and a connection member 105 made of a magnetic material for magnetically connecting the permanent magnets 104*a*, 104*b*.

The permanent magnets 104*a*, 104*b* have a substantially cuboid shape, and are arranged so that the opposing surfaces have different polarities while being attached to the inner surfaces of the opposing walls 106 of the connection member 105. The polarities of the opposing surfaces are to be set such that the direction of the force acting on the arc current is directed toward an intermediate wall 107 of the connection member 105, to be described later, according to the difference in the direction the current flows between the contacts.

According to the configuration, the arc current can be deformed to a position where the adverse effect of the arc current is applied the least, and then extinguished.

The connection member 105 is bent such that the end sides face each other by press working a plate-like magnetic material. The permanent magnets 104*a*, 104*b* are adsorbed and fixed by the magnetic force to the inner surface of each opposing wall 106. A closed loop is formed as a magnetic circuit in which the magnetic flux generated from one of permanent magnets 104*a*, 104*b* returns from the other one of permanent magnets 104*a*, 104*b* via the connection member 105.

Thus, according to the arc extinguishing member 103, not only the pair of permanent magnets 104*a*, 104*b*, but also the connection member 105 for magnetically connecting the permanent magnets 104*a*, 104*b* is arranged. The magnetic circuit to become the closed loop is thus formed, and the magnetic flux leakage is less likely to occur. As a result, even if an arc is generated at the time of opening/closing of the contact, the arc is extended in a direction orthogonal to the direction in which the arc current flows by the Fleming's left hand rule, and can be extinguished in a short period of time.

According to the configuration, the magnetic field generated from the permanent magnet configures a closed loop through a connection member having high magnetic permeability compared to the surrounding atmosphere. Therefore, the magnetic flux can be concentrated at the contact open/close position. As a result, the influence of the magnetic field by the arc extinguishing member can be sufficiently acted on the arc current generated at the time of opening/closing of the contact, and the arc current can be sufficiently stretched to the upper side and extinguished at an early stage.

An assembly method of the electromagnetic relay having the above configuration will now be described.

The coil 53 is wound around the body portion 57 of the spool 52, and the coil terminal 67 is press-fitted and fixed to the terminal holding hole 62 of the lower end guard portion 59. The ends of the coil 53 are wound and soldered to the coil winding portion 68 of the coil terminal 67. The iron core 51 is inserted to the center hole 56 of the spool 52 from the lower end side, and the yoke 55 is swaged and anchored to a portion projecting out from the upper end. The electromagnet block 2 is thereby completed.

The completed electromagnet block 2 is attached to the first base section 6.

In the attachment of the electromagnet block 2, the card member 65 is attached to the integrated moving iron 4 and the hinge spring 44, and to the first attachment section 8 of the first base section 6. In other words, the latching portion 77 of the hinge spring 44 is positioned in the protrusion 18 and the recessed portion 19 of the first base section 6. The moving iron 4 is then arranged on the upper side of the hinge spring 44, and the electromagnet block 2 is arranged further on the upper side. The electromagnet block 2 is fixed to the first base section 6 by positioning the guide projection 66 in the positioning recessed portion 12, inserting both ends of the yoke 55 in the guide groove 17, and press-fitting the coil terminal 67 to the coil terminal hole 13. The moving iron 4 is pivotably supported at the corner of the lower end of the yoke 55.

In this state, the bottom surface of the projecting section 72 of the yoke 55 and the bottom surface of the terminal attachment portion 61 of the spool 52 come into contact with the upper surface of the base portion 10 of the first base section 6. A gap in which the moving iron 4 can pivot is formed between the upper surface of the base portion 10 of the first base section 6 and the magnet pole section 54 of the iron core 51 exposed at the lower end section of the spool 52. The shielding wall 70 of the card member 65 integrated with the moving iron 4 is then arranged over the insulating wall 16 of the base block 1. The insulating property between the electromagnet block 2 and the contact switching unit 3 is sufficiently ensured by the guide wall 15 and the insulating wall 16 of the base block 1, and the shielding walls 97, 98 of the card member 65.

The contact switching unit 3 is attached to the first base section 6.

In the attachment of the contact switching unit 3, the terminal portion 79*d* of the movable touch piece 79 is inserted to the first terminal holes 22*a*, 22*b*, and the press-fit portion 79*c* is press-fitted and anchored. The upper end of the movable touch piece 79 is sandwiched between the protrusions 96 of the card member 65 attached first, and pressure contacted to the coupling portion 73. The elastic force of the movable touch piece 79 thus acts on the moving iron 4, and the moving iron 4 is positioned at the initial position where the section 88 to be drawn is spaced apart from the magnet pole section 54 of the iron core 51.

The terminal portion 78*b* of the fixed touch piece 78 is then inserted to the second terminal holes 24*a*, 24*b* of the first base section 6, and the press-fit portion 78*a* is press-fitted and fixed. In this state, the fixed touch piece 78 faces the movable touch piece 79 with a predetermined interval, so that the movable contact 81 can touch and separate with the fixed contact 80.

Furthermore, one movable touch piece 79A that projects out from the bottom surface of the first base section 6 and one fixed touch piece 78B are connected by the connection terminal 39. In other words, the terminal portion 79*d* of one movable touch piece 79A and the terminal portion 78*b* of one fixed touch piece 78B are respectively inserted to the through-holes 40*a*, 40*b* of the connection terminal 39, and electrically connected by soldering.

The second base section 7 fixed with the tab terminals 41, 42, 45, 46 is attached to the first base section 6.

In the fixation of the tab terminals 41, 42, 45, 46, the press-fit portions 41*b*, 42*b*, 45*b*, 46*b* of the tab terminals 41, 42, 45, 46 are press-fitted to the press-fitting hole 29*a* to 29*c* of the second base section 7. The connecting portions 41*c*, 42*c*, 45*c*, 46*c* of the tab terminals 41, 42, 45, 46 are arranged in the recessed portions 31, 32, 34, 35 formed at the bottom surface of the first base section 6, and the through-holes 41*d*, 42*d*, 45*d*, 46*e* of the connecting portions 41*c*, 42*c*, 45*c*, 46*c* match the positions of the through-holes 28*a* to 28*d* of the second base section 7.

In the attachment of the second base section 7 to the first base section 6, the lower end of the first base section 6 is fitted and integrated to the rectangular recessed area 26 of the second base section 7. In this case, the terminal portion 47 of the coil terminal 67 is inserted to the through-hole 41*d* of the first tab terminal 41 and the through-hole 42*d* of the second tab terminal 42. The terminal portion 79*d* of the movable touch piece 79 is inserted to the through-hole 45*e* of the third tab terminal 46, and the terminal portion 78*b* of the fixed touch piece 78 is inserted to the through-hole 46*e* of the fourth tab terminal 45. The terminal portions 78*b*, 79*d* of the touch pieces 78B, 79A to be inserted to the through-holes 28*a* to 28*d* are electrically connected by soldering.

The arc extinguishing member 103 is attached to the case 5.

In the attachment of the arc extinguishing member 103, the opposing walls 106 of the connection member 105 and the permanent magnets 104*a*, 104*b* are respectively inserted to each recessed portion 100 formed in the case 5 with the permanent magnets 104*a*, 104*b* attached to the opposing walls 106 of the connection member 105. The connection member 105 is then anchored to the case 5 by thermal swaging. The case 5 attached with the arc extinguishing member 103 is then placed over the base block 1, and the fitting portion thereof is sealed.

The internal space is to be in a sealed state by thermally sealing the resin sealing hole 99. However, use can be made with the internal space communicating with the surrounding atmosphere with the resin sealing hole 99 opened.

In the electromagnetic relay assembled in this manner, other configuring components excluding the second base can be used as it is without barely changing the configuration used from the prior art. The electromagnetic relay corresponding to other types may be obtained by arranging the second base section 7. Here, the connection terminal 39 is arranged to connect the movable touch piece 79 and the fixed touch piece 78, so that the contacts can be opened and closed at two areas in the middle of the same electric path. The electrical connecting position to other components (e.g., print substrate) of the electromagnetic relay can be freely set by arranging four tab terminals 41, 42, 45, 46.

According to the configuration, the arc extinguishing member can be arranged in a completely insulated state from the contact switching unit and the electromagnet block, which are internal configuring components.

The operation of the electromagnetic relay having the above configuration will now be described.

In a state that a current does not flow in the coil 53 and the electromagnet block 2 is demagnetized, the section 88 to be drawn is located at an initial position spaced apart from the magnet pole section 54 of the iron core 51 with the fulcrum, at which the moving iron 4 is supported by the yoke 55 with an elastic force of the movable touch pieces 79A, 79B, as the center. Therefore, the opened state in which the movable contact 81 is spaced apart from the fixed contact 80 is maintained.

If a current flows in the coil 53 and the electromagnet block 2 is magnetized, the moving iron 4 has the section 88 to be drawn to the magnet pole section 54 of the iron core 51 and is pivoted against the biasing force of the movable touch pieces 79A, 79B, as shown in FIG. 12. The movable touch pieces 79A, 79B are thereby elastically deformed, and the movable contact 81 closes with respect to the fixed contact 80 of the fixed touch piece 78.

If the current flow in the coil 53 is shielded and the electromagnet block 2 is demagnetized, the moving iron 4 loses the drawing force of the iron core 51 and pivots by the elastic force of the movable touch pieces 79A, 79B, as shown in FIG. 13. The movable contact 81 thus separates from the fixed contact 80.

In this case, the arc is sometimes generated between the contacts, but since the arc extinguishing member 103 is arranged at the periphery of the opening/closing of the contact region the generated arc is rapidly extinguished.

In other words, as shown in FIG. 11, a magnetic circuit to become a closed loop is configured by that the magnetic flux generated from the N pole of one permanent magnet 104*a* reaches the S pole of the other permanent magnet 104*b*, and returns to the S pole of the former permanent magnet 104*a* through the connection member 105. Thus, magnetic flux leakage to the periphery barely occurs, and the magnetic force can be effectively acted on the arc generated between the contacts. Specifically, when the connection member 105 is arranged, the magnetic flux density at the contact open/close position can be enhanced 53.3% compared to when only the permanent magnets 104*a*, 104*b* are arranged. As a result, the force acts in the direction orthogonal to the contact opening direction on the generated arc due to the Fleming's left hand rule, and the arc is greatly extended and thus can be rapidly extinguished.

In this case, the fixed contact pieces 78A, 78B can be opened and closed with the movable touch pieces 79A, 79B, so that the arc current at the time of contact opening flows in the direction indicated in FIG. 11. The magnetic poles of the permanent magnets 104*a*, 104*b* are set so as to become different poles on the opposing surfaces to obtain the magnetic flux direction in which the arc can be deformed toward the intermediate wall 107 of the connection member 105. That is, the arc can be more reliably extinguished by deforming the arc toward the intermediate wall 107 of the connection member 105.

According to the present invention, the connection member is arranged at the periphery of the contact open/close position, and the permanent magnets are arranged at the opposing portions, so that the magnetic field generated from the permanent magnets can be effectively concentrated at the contact open/close position. Thus, even if the arc current is generated at the time of opening/closing of the contact, the arc current can be deformed to the upper side by the magnetic field and extinguished at an early stage.

There has thus been shown and described an electromagnetic device and electromagnetic relay using the same which fulfills all the advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. An electromagnetic relay comprising:

a contact switching unit having a contact group comprising a pair of contacts adapted to open and close;

an electromagnet block which drives the contact switching unit to open and close the contacts; and an arc extinguishing member comprising a connection member, the connection member being formed by connecting, via a middle part, opposing walls arranged in a direction perpendicular to the open/close direction of the contacts, and permanent magnets being disposed on opposing sections of the opposing walls, wherein each permanent magnet is configured such that a polarity of opposing surfaces of said permanent magnets, and a direction in which an arc current, generated at a time of opening/closing of the pair of contacts, flows, are determined such that a force is generated on the arc current for displacing the arc current towards a middle part of the connection member.

2. The electromagnetic relay according to claim 1, further comprising:

a base block mounting the contact switching unit and the electromagnet block, and a case attached to the base block covering the contact switching unit and the electromagnet block, wherein the case comprises a recessed portion over which the opposing walls and the permanent magnets of the arc extinguishing member are arranged.

3. The electromagnetic relay according to claim 2, wherein the contact switching unit comprises:

a pair of movable touch pieces;

a pair of fixed touch pieces comprising a fixed contact facing, a movable contact of each movable touch piece, the fixed contact is adapted to touch and separate with the movable contact; and a connection terminal for electrically connecting one of the movable touch pieces and one of the fixed touch pieces.

4. The electromagnetic relay according to claim 3, wherein the base block is configured with a first base section having the touch pieces and the electromagnet block, and a second base having tab terminals respectively connected to the touch pieces and coil terminals of the electromagnet block.

5. The electromagnetic relay according to claim 1, wherein the contact switching unit comprises:

a pair of movable touch pieces;

a pair of fixed touch pieces comprising a fixed contact facing, a movable contact of each movable touch piece, the fixed contact is adapted to touch and separate with the movable contact; and a connection terminal for electrically connecting one of the movable touch pieces and one of the fixed touch pieces.

6. The electromagnetic relay according to claim 5, wherein the base block is configured with a first base section having the touch pieces and the electromagnet block, and a second base having tab terminals respectively connected to the touch pieces and coil terminals of the electromagnet block.

7. The electromagnetic relay according to claim 1, wherein each permanent magnet is configured such that a polarity of the opposing surfaces and a direction in which an arc current generated at a time of opening/closing of the contact flows are determined such that a force is generated on the arc current for displacing towards a middle part of the connection member.

8. The electromagnetic relay according to claim 7, wherein the contact switching unit comprises:

a pair of movable touch pieces;

a pair of fixed touch pieces comprising a fixed contact facing, a movable contact of each movable touch piece, the fixed contact is adapted to touch and separate with the movable contact; and a connection terminal for electrically connecting one of the movable touch piece and one of the fixed touch piece.

9. The electromagnetic relay according to claim 8, wherein the base block is configured with a first base section having the touch pieces and the electromagnet block, and a second base having tab terminals respectively connected to the touch pieces and coil terminals of the electromagnet block.

* * * * *